United States Patent [19]

Leiber et al.

[11] 4,438,420

[45] Mar. 20, 1984

[54] ELECTROMAGNETIC ACTIVATION DEVICE

[75] Inventors: Heinz Leiber, Oberriexingen; Alwin Stegmeier, Schwieberdingen, both of Fed. Rep. of Germany

[73] Assignee: Robert Bosch GmbH, Stuttgart, Fed. Rep. of Germany

[21] Appl. No.: 423,578

[22] Filed: Sep. 27, 1982

[30] Foreign Application Priority Data

Mar. 3, 1982 [DE] Fed. Rep. of Germany ..... 3107619

[51] Int. Cl.[3] ..... H01F 7/08

[52] U.S. Cl. ..... 335/275; 335/261; 335/274

[58] Field of Search ..... 335/255, 261, 262, 274, 335/275

[56] References Cited

U.S. PATENT DOCUMENTS

| | | | |
|---|---|---|---|
| 2,661,412 | 12/1953 | Drefus | 335/262 X |
| 2,853,660 | 9/1958 | Immel | 335/274 X |
| 2,858,487 | 10/1950 | Immel | 335/262 X |
| 2,992,304 | 7/1961 | Andrews | 335/261 |

FOREIGN PATENT DOCUMENTS

| | | | |
|---|---|---|---|
| 56-157008 | 4/1981 | Japan | 335/255 |

*Primary Examiner*—George Harris
*Attorney, Agent, or Firm*—Edwin E. Greigg

[57] ABSTRACT

An electromagnetic activation device for valves using a hinged armature magnet. The hinged armature itself is attached to the free end of a leaf spring fastened on one end on the magnetic body and extends into the magnetic body. This leaves at least two guide air gaps ($S_1$, $S_2$) with specified measurements. In this manner an advantageous magnetic efficiency with only minimal friction losses is achieved and the electromagnetic activation device can be used advantageously with anti-blocking control devices in motor vehicle brake system.

10 Claims, 3 Drawing Figures

ELECTROMAGNETIC ACTIVATION DEVICE

BACKGROUND OF THE INVENTION

The present invention is based on an electromagnetic activation device in accordance with the teaching set forth herein. Such an activation device is known (German Auslegeschrift No. 12 47 793).

In such a known device the orientation of the armature plays a decisive role in regard to the costs as well as the degree of efficiency of the magnet. If formed with two magnetic poles, it is possible to obtain a comparatively small starting force and a large end force, since with a given magnetic circuit and excitation (amperage times number of coil turns) the power of the magnetic force has a squared relationship to the air gap. Therefore, when the air gap is twice as large, the magnetic force will only be ¼ of that previously measured.

Therefore it is already known to use single pole arrangements (Swiss Pat. No. 367 022). However, very often differing radial forces are encountered here, so that such magnets are very difficult to control, i.e. to design.

OBJECT AND SUMMARY OF THE INVENTION

In contrast to the foregoing, the electromagnetic activation device has the advantage that the degree of magnetic efficiency is very great and that friction losses are avoided to a large extent.

Furthermore, it is advantageous that, because of the friction-free pivoting of the armature, comparatively large controlling forces can be achieved with small losses.

In addition, there is the advantage of low construction and small amperage.

Finally, it is advantageous that by the use of a leaf spring the parts of the magnetic circuit can be manufactured by means of an efficient process, such as by stamping or sintering.

The invention will be better understood and further objects and advantages thereof will become more apparent from the ensuing detailed description of preferred embodiments taken in conjunction with the drawings.

BRIEF DESCRIPTION OF THE DRAWINGS

Three exemplary embodiments of the present invention are shown in the drawings and are further described in the following description.

DESCRIPTION OF THE PREFERRED EMBODIMENTS

Figure 1:
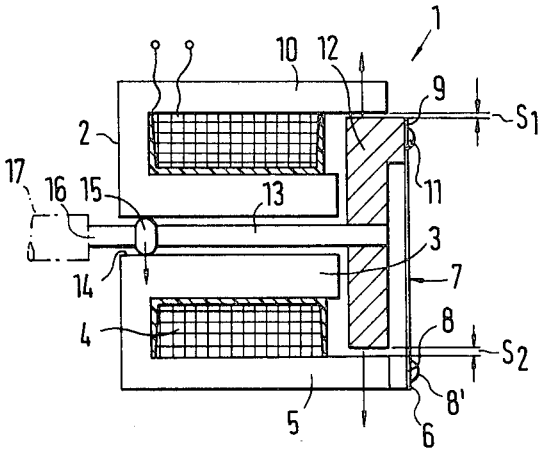
FIG. 1 shows a magnet with an E-shaped yoke.

An electromagnetic activation device 1 has an E-shaped yoke 2, onto the center section 3 of which a coil 4 is placed. In this manner a single-pole magnet 2/4 is constructed here.

At a lower leg 5 of the yoke 2, and end 6 of a leaf spring 7 has an attachment point 8, to which it is fastened by means of a screw 8' or the like. Its free end 9 extends in the direction towards an upper end 10 of the yoke 2 and supports a hinged armature 12, also fastened with a screw 11 or the like. Because the pivot point of the leaf spring 7 at the armature is placed as far as possible from the attachment point 8 of the leaf spring 7, the largest possible axial lift of the hinged armature is achieved.

The hinged armature 12 fills to the largest extent possible the space between the two outer legs 5 and 10 of the E-shaped yoke 2, namely in such a way that it keeps open two guide air gaps $S_1$ and $S_2$ between itself and the legs 5 and 10. The guide air gap $S_1$, located farther away from the attachment point 8, is smaller than the guide air gap $S_2$.

Centrally on the armature 12 a valve actuation rod 13 is disposed, extending through a longitudinal bore 14 in the center section 3 and mounted in the bore 14 by means of a ball joint attachment 15. On its free end 16, protruding from the bore 14, a valve part 17 (not further described) of a switching valve is disposed.

Method of Operation:

When current for the coil 4 is switched off and on, the armature 12 moves back and forth in the air guide gaps $S_1$ and $S_2$ and imparts a longitudinal movement to the valve actuation rod 13 for the activation of the valve part 17. The return of the armature 12 can be achieved by means of the leaf sring 7 itself or by means of other spring elements disposed in the magnet or valve parts.

Because of the differing configuration of the two air gaps $S_1$ and $S_2$, the resulting radial magnetic force acts in the direction of the smaller air gap $S_1$. However, since the armature 12 is fastened to the lower leg 5 by the leaf spring 7, the leaf spring 7 is, in addition to its valve actuating movement directed towards the coil 4, also stressed for pull, i.e. it is drawn upwardly in the drawing. During the work lift of the magnet the previously narrower air gap $S_1$ widens and the previously wider air gap $S_2$ narrows. However, yoke 2 and the armature 12 do not touch. Because of its fastening with the ball joint attachment 15 the minimal lateral movement of the valve actuation rod 13 does not interfere with the working of the valve. In this manner, large magnetic forces can be set in motion and the friction occuring at the valve actuation rod 13 only is very small.

Figure 2:
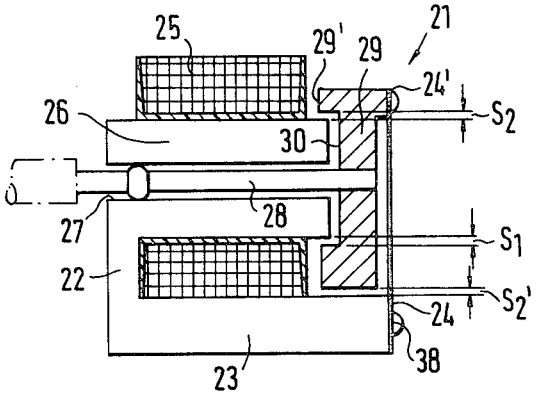
FIG. 2 shows a magnet with a U-shaped yoke.

In the construction according to FIG. 2 an electromagnetic activation device 21 has a U-shaped yoke 22, on the (lower) leg 23 of which a leaf spring 24 is fastened to an attachment point 38. A coil 25 is attached on the other (upper) arm 26. In this manner a magnetic body 22/25 is formed. The leg 26 supporting the coil 25 is equipped with a longitudinal bore 27 containing a valve actuation rod 28.

An armature 29 is fastened to the free end 24' of a leaf spring 24. It has a recess 30, so that it can extend beyond the free end of the leg 26 to a certain extent with its overhanging edge 29'.

In this arrangement, three guide air gaps $S_1$, $S_2$ and $S_2$, are formed, of which $S_1$<than $S_2$ and $S_2$, by an order of magnitude (depending on the construction of the magnet) which assures that the leaf spring is stressed for pull under all operational conditions. In accordance with this condition, the leaf spring 24 here is also stressed for pull.

Figure 3:
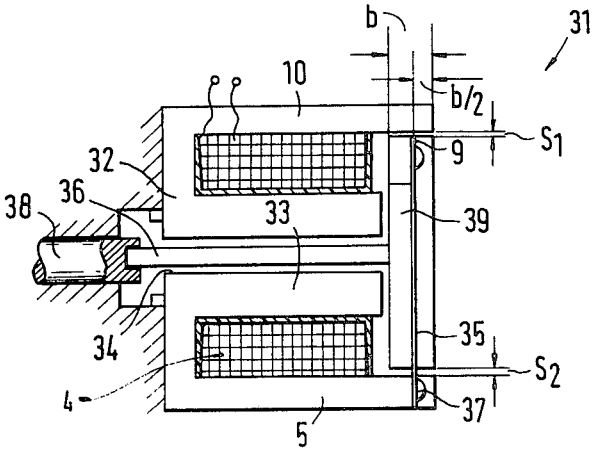
FIG. 3 an embodiment as in FIG. 1, but with a differently arranged armature.

The construction according to FIG. 3 is similar to the one according to FIG. 1. In this case an electromagnetic activation device 31 again has an E-shaped yoke 32, on the central part 33 of which the coil 4 is placed. In this manner a magnetic body 32/4 is formed here.

A longitudinal bore 34 in the central part 33 is designed to contain a valve actuation rod 36. Here, again, an armature 39 is fastened on one side on a leaf spring 35, which is attached on its lower end only at an attachment point 37 on the outer leg 5.

The leaf spring 35, in this type of construction, is disposed at approximately half the distance (b/2) of the width b of the guide air gap $S_1$ on the other outer leg 10.

In this manner frictional forces on the magnet are entirely avoided and the supporting forces are decreased. The valve actuating rod 36 can activate directly, i.e. without further support, a slide 38.

The foregoing relates to preferred exemplary embodiments of the invention, it being understood that other embodiments and variants thereof are possible within the spirit and scope of the invenntion, the latter being defined by the appended claims.

What is claimed and desired to be secured by Letters Patent of the United States is:

1. An electromagnetic activation device for valves comprising a magnetic body, a hinged armature fastened on one side to said body and a valve actuation rod connected to said armature, a leaf spring connected at one end to said magnetic body and having a free end, said hinged armature attached to said free end of said leaf spring having an attachment point on one side of a single pole magnetic body and said hinged armature extends into the magnetic body while leaving a guide air gap between said armature and said magnetic body.

2. An electromagnetic activation device in accordance with claim 1, characterized in that said hinged armature is disposed in the magnetic body while leaving two guide air gaps ($S_1$, $S_2$), and in that the guide air gap ($S_1$) further distant from the attachment point of said leaf spring is smaller than the guide air gap ($S_2$) closer to the attachment point.

3. An electromagnetic activation device in accordance with claim 1, wherein said magnetic body is E-shaped characterized in that the attachment point of said leaf spring is on an outer leg of the E-shaped magnetic body and the valve actuation rod is on a center section (3, 33) of the E-shaped magnetic body.

4. An electromagnetic activation device in accordance with claim 2, wherein said magnetic body is E-shaped characterized in that the attachment point of said leaf spring is on an outer leg of the E-shaped magnetic body and the valve actuation rod is on a center section (3, 33) of the E-shaped magnetic body.

5. An electromagnetic activation device in accordance with claim 3, characterized in that the guide air gaps ($S_1$, $S_2$) are, respectively, disposed on the outer legs of the E-shaped magnetic body.

6. An electromagnetic activation device in accordance with claim 4, characterized in that the guide air gaps ($S_1$, $S_2$) are, respectively, disposed on the outer legs of the E-shaped magnetic body.

7. An electromagnetic activation device as set forth in claim 3, 4, 5, or 6 characterized in that the leaf spring is disposed at approximately one-half the width (b/2) of the guide air gap ($S_1$).

8. An electromagnetic activation device in accordance with claim 1 in which said magnetic body is U-shaped, said magnetic body including windings which are disposed on one of the two U-legs, characterized in that the attachment point of said leaf spring is on one leg of the U and that said valve actuation rod and a free end of the leaf spring are disposed on the leg of the U which is surrounded by the winding.

9. An electromagnetic activation device in accordance with claim 2 in which said magnetic body is U-shaped, said magnetic body including windings which are disposed on one of the two U-legs, characterized in that the attachment point of said leaf spring is on one leg of the U and that said valve actuation rod and a free end of the leaf spring are disposed on the leg of the U which is surrounded by the winding.

10. An electromagnetic activation device as set forth in claim 8 or 9 characterized in that the hinged armature extends around the leg of the U surrounded by the winding (25), on the inside and the outside and that two guide air gaps ($S_1$, $S_2$) are disposed adjacent said U-legs surrounded by said winding and one guide air gap ($S_2$,) is disposed adjacent another leg of which the middle guide air gap ($S_1$) is smaller than the sum of both other guide air gaps ($S_2$, $S_2$, ).

* * * * *